United States Patent [19]

Carini

[11] 4,312,400

[45] * Jan. 26, 1982

[54] CONTINUOUS CASTING METHOD AND MOLD FLUX POWDERS

[75] Inventor: George F. Carini, Penn Hills, Pa.

[73] Assignee: The Clay Harden Company, Pittsburgh, Pa.

[ * ] Notice: The portion of the term of this patent subsequent to Feb. 26, 1997, has been disclaimed.

[21] Appl. No.: 124,342

[22] Filed: Feb. 25, 1980

Related U.S. Application Data

[63] Continuation-in-part of Ser. No. 874,024, Feb. 1, 1978, Pat. No. 4,190,444.

[51] Int. Cl.[3] ..... C22B 9/10; B22D 11/00; B22D 27/00

[52] U.S. Cl. ..... 164/472; 164/459; 75/257; 75/53

[58] Field of Search ..... 164/55, 56, 73, 82; 75/257, 129, 53–58

[56] References Cited

U.S. PATENT DOCUMENTS

| | | | |
|---|---|---|---|
| 3,320,052 | 5/1967 | Bowden | 75/55 X |
| 3,704,744 | 12/1972 | Halley et al. | 164/82 |
| 3,708,314 | 1/1973 | Kishida et al. | 164/73 X |
| 3,937,269 | 2/1976 | Salvadore et al. | 164/73 |
| 4,190,444 | 2/1980 | Carini | 164/73 X |

*Primary Examiner*—R. L. Spruill
*Assistant Examiner*—K. Y. Lin
*Attorney, Agent, or Firm*—Webb, Burden, Robinson & Webb

[57] ABSTRACT

This invention relates to mold flux powders for the continuous casting of steel. The mold flux powders comprise a plurality of sequential melting systems forming successive melts each of which assimilates the ingredients of the next system into the melt. In this way, the desired fluidity is achieved in the mold flux at a rate required by the particular continuous casting process in which the flux is being used without resorting to an excessively low melting flux. At least one of the systems comprises a finely-divided glass.

9 Claims, No Drawings

CONTINUOUS CASTING METHOD AND MOLD FLUX POWDERS

RELATED APPLICATION

This application is a continuation-in-part of Application Ser. No. 874,024, filed Feb. 1, 1978, now U.S. Pat. No. 190,444 having the same title.

BACKGROUND

The importance of providing proper flux over the molten metal surface in a continuous casting mold is apparent from the numerous patents which have issued relating to the subject. See U.S. Pat. Nos. 3,970,135; 3,964,916; 3,949,803; 3,937,269; 3,926,246; 3,899,324; 3,891,023; 3,788,840; 3,718,173; 3,708,314; 3,704,744; 3,685,986; 3,677,325; 3,649,249; 3,642,052; 3,607,234; 3,318,363; 3,052,936; 2,825,947.

Much of the prior art focuses on softening point and fluidity of the melted fluxes. Little consideration has been given to rates; that is, the rate at which the mold flux powder melts sufficiently to spread and the rate at which the mold flux powder achieves its final desired fluidity so that it can be carried out of the mold in the space between the billet, bloom or slab being cast and the mold walls. If a mold flux remains over the surface of the metal in the mold too long, it either picks up too much of the deoxidation product it is designed to scavenge, and therefore loses fluidity, or it becomes so loaded with these products that it cannot pick up additional deoxidation products which it is supposed to remove. Certain prior art fluxes have actually "iced over" in the mold, due to low tolerance to deoxidation products, e.g., alumina. Some consideration has been given to the rates at which the deoxidation products are taken into the molten flux, but the reasoning has been superficial. The important consideration is the rate of removal of the deoxidation products from the mold. This rate is controlled not only by the rate at which the deoxidation products are taken into the melt, but also the fluidity tolerance of the melt to dissolved deoxidation products and the rate at which the loaded flux is removed from the mold. Either rate can be controlling and, of course, they are usually interrelated.

Because numerous types of grades of steels are being continuously cast, i.e., stainless steel, high-carbon steel, low-carbon steel, aluminum-killed steel, etc., all at different temperatures and different casting rates the continuous caster must have available a range of flux compositions which will have a softening point and fluidity compatible with the particular product and casting rate. If a mold flux is too fluid or becomes fluid too fast, it will be carried away from the mold at a higher rate than desirable. The drawback to the too rapid removal of mold flux from the mold is the resultant decrease in surface quality of the cast shape and the need for larger amounts of mold flux powder to be spread over the mold during casting. These, of course, are important economic considerations.

In the past, casting fluxes having lower melt point temperatures and greater fluidity than necessary have sometimes been adopted simply because this was the only means of achieving sufficiently rapid melting, spread, and solubility for deoxidation products. Applicant provides a mold flux which has a controlled rate of fusion, rapid spread, intermediate fluidity, and high tolerance to dissolved deoxidation products which does not adopt low melt and/or softening point temperatures simply to provide the desired rate of melting, spread, and removal of deoxidation products.

SUMMARY OF THE INVENTION

This invention relates to a mold flux powder useful for continuous casting of numerous steel grades and which has been found to provide exceptional casting surfaces in various steels including, for example, aluminum-killed steels which are known to be particularly difficult to cast. The following table sets forth the ranges of the preferred compositions. Within these ranges, as explained herein in detail, the composition can be varied to provide the desired softening point and fluidity.

TABLE I-A

| Batch Ingredient | Weight Percentage |
|---|---|
| Refractory Glass (softening points 1800 to 2200° F.) and Whiting | 40 to 80 |
| Cryolite, Fluorspar, Sodium Fluoride and mixtures thereof | 10–30 |
| Lower Temperature Melting Glass or Glass Mixtures (softening points 1200 to 2000° F.) | 10–30 |
| Sodium Nitrate | up to 1 |

Table I-B sets forth the ranges for a very successful substantially aluminum-free embodiment.

TABLE I-B

| Batch Ingredient | Weight Percentage |
|---|---|
| Refractory Glass (softening point in excess of 1800° F.) and Whiting | 40 to 80 |
| Fluorspar and Sodium Fluoride | 10 to 30 |
| Lower Temperature Melting Glass or Glass Mixtures (softening points 1200 to 2000° F.) | 10 to 30 |
| Barium Carbonate | up to 5 |
| Sodium Nitrate | up to 1 |

The preferred range of ratios of refractory glass to whiting is from 0.65 to 0.75 by weight. Workable refractory glass to whiting ratios exist between 0.5 and 2.0. Whiting is natural or synthetic calcium carbonate. Partial substitution of barium carbonate for whiting is permissable and may even be desirable in certain applications.

The preferred lower temperature melting glass composition comprises, in weight percent, $Na_2O$-8 to 18; $K_2O$-up to 8; $B_2O_3$-15 to 25; $SiO_2$-20 to 35; $F_2$-4 to 8; CaO-10 to 15, and BaO-10 to 15. The softening point temperature of the lower temperature melting glass or mixtures of glass should preferably be between 1300° to 1800° F. Workable glass compositions, comprise, in weight percent, $Na_2O$-8 to 25; $K_2O$-0 to 8; $B_2O_3$-0 to 25; $SiO_2$-20 to 75; $F_2$-0 to 12; CaO-10 to 30; MgO-0 to 3; BaO-0 to 15; and $Al_2O_3$-0 to 3.

Glass cullet is usually a refractory glass in the sense of having a melting point temperature in excess of 1800° F.

The compositions set forth in the above table are comprised of at least three and sometimes four fluxing systems which sequentially melt and act to flux (promote melting) of the next system. In actual use, the sodium nitrate melts almost immediately and in addition to its fluxing effect on other components, serves to provide a certain tackiness to the remaining ingredients to minimize dusting in the mold.

The next system of ingredients to melt is the lower temperature melting glass. The melting point and amount of glass (or mixture of glasses) may be selected to provide the desired rate of melting. This glass or mixture of glasses is perhaps the most significant ingredient for achieving the desired melting rate for the overall flux powder system.

After and to some extend during the melting of the glass, the fluorine containing compounds, i.e., fluorspar, cryolite and sodium fluoride, which are present in a low melting relationship react and melt. Finally, the melt comprising the ingredients of the glass and fluorine compounds take the whiting-refractory glass system into solution. The lime is added to the overall composition so that the lime-silica ratio of the melted flux promotes with sodium and fluorine the solution of deoxidation products, for example, alumina where the steel being cast is aluminum-killed steel. The final flux composition depends upon a number of factors, for example, the residence time of the flux over the metal and the particular type of metal being cast. Hence, the final melted flux composition is determined not only by the composition of the mold powder but by the presence of the deoxidation products which the mold flux is designed to dissolve and to remove.

DESCRIPTION OF THE PREFERRED EMBODIMENTS

Mold flux powders were prepared and tested for softening point. In these examples, Glass A, Glass B and Glass C have softening point temperatures of 1300°, 1400° and 1800° F. respectively. The chemical analyses of Glasses A, B and C are given in the following table. The percentages are by weight.

TABLE II

| | Glass A | Glass B | Glass C |
|---|---|---|---|
| $Na_2O$ | 15.5% | 9.0% | 13.83% |
| $K_2O$ | 5.61 | 5.55 | 0.57 |
| $B_2O_3$ | 20.45 | 20.23 | |
| $SiO_2$ | 25.60 | 32.74 | 72.15 |
| $F_2$ | 5.52 | 5.47 | |
| CaO | 13.21 | 13.06 | 10.20 |
| MgO | | | 0.91 |
| BaO | 14.11 | 13.96 | 0.12 |
| $Al_2O_3$ | | | 2.12 |
| $Fe_2O_3$ | | | 0.11 |

The glass analyses set forth in Table II are intended to be exemplary only. Other glass compositions would be expected to work well.

Within the compositional ranges disclosed herein, a particularly good substantially alumina-free flux, suitable for casting of drawing quality aluminum-killed steels for sheet and strip applications in which the range of aluminum in the ladle may vary from 0.015 to 0.096 weight percent, may be batched. Drawing quality steels are especially high in aluminum and require the removal of substantial quantities of aluminum oxide, which becomes available at the surface of the steel in the continuous casting mold, to achieve the desired surface and internal quality.

TABLE III

| Example | I | II |
|---|---|---|
| Glass A | — | 20 |
| Glass B | 20 | — |
| Glass C | 25 | 25 |
| Fluorspar | 10 | 10 |
| Sodium Fluoride | 10 | 10 |
| Whiting | 30 | 30 |
| Barium Carbonate | 4 | 4 |

TABLE III-continued

| Example | I | II |
|---|---|---|
| Sodium Nitrate | 1 | 1 |

In Examples I and II, Glasses A and B are low melting glasses that comprise a first melting system, fluorspar and sodium fluoride comprise a second melting system and whiting, barium carbonate and Glass C comprise a third melting system. (Sodium nitrate is the fastest melting ingredient and makes the flux powder tacky as it enters the mold reducing dusting). Depending on the amount used and the presence of the other higher and lower melting glasses and the nature of the fluorine containing ingredients, a glass may be used as part of the first system or the third system. Note that in Examples I and II, cryolite has been excluded and sodium fluoride included.

A variation of Examples I and II containing 2% anhydrous boric acid and 5% flake graphite has proven to be exceptional in continuous casting of drawing quality steels for sheet and strip applications.

The overall chemical analyses of the fluxes of Examples I and II are as set forth in Table IV:

TABLE IV

| Example | I | II |
|---|---|---|
| $SiO_2$ | 23.76 | 22.38 |
| $Al_2O_3$ | less than 1.00 | less than 1.00 |
| $Fe_2O_3$ | trace | trace |
| $F_2$ | 10.00 | 10.00 |
| $B_2O_3$ | 3.60 | 3.96 |
| CaO + MgO | 28.66 | 28.68 |
| BaO | 5.67 | 5.71 |
| $Na_2O$ | 12.63 | 13.89 |
| $K_2O$ | 1.08 | 1.08 |
| LOI | 14.59 | 14.23 |
| Softening Point | 1700° F. | 1675° F. |

Variation of Example I containing 2% anhydrous boric acid

| | |
|---|---|
| $SiO_2$ | 23.28 |
| $Al_2O_3$ | less than 1.00 |
| $Fe_2O_3$ | trace |
| $F_2$ | 9.80 |
| $B_2O_3$ | 5.60 |
| CaO + MgO | 28.09 |
| BaO | 5.56 |
| $Na_2O$ | 12.38 |
| $K_2$ | 1.06 |
| LOI | 14.30 |
| Softening Point | 1650° F. |

Within the compositional ranges disclosed herein, an alumina-free flux suitable for casting alloyed steels containing titanium, zirconium, and aluminium may be batched.

TABLE V

| Example | III | IV |
|---|---|---|
| Glass A | — | 25 |
| Glass B | 25 | — |
| Glass C | 20 | 20 |
| Fluorspar | 7.3 | 7.3 |
| Sodium Fluoride | 12.7 | 12.7 |
| Whiting | 30 | 30 |
| Barium Carbonate | 4 | 4 |

TABLE V-continued

| Example | III | IV |
|---|---|---|
| Sodium Nitrate | 1 | 1 |

Example III differs from Example I in the ratios of fluorspar to sodium fluoride and the ratios of glasses A and B to glass C. (The same difference exists between Examples II and IV). The fluorspar and sodium fluoride are combined in an eutetic mixture in Examples III and IV.

The overall chemical analyses of the fluxes of Examples III and IV are as set forth in Table VI:

TABLE VI

| Example | I | II |
|---|---|---|
| $SiO_2$ | 21.88 | 20.16 |
| $Al_2O_3$ | less than 1.00 | less than 1.00 |
| $Fe_2O_3$ | trace | trace |
| $F_2$ | 10.31 | 10.32 |
| $B_2O_3$ | 4.90 | 4.94 |
| CaO + MgO | 26.63 | 26.67 |
| BaO | 6.40 | 6.44 |
| $Na_2O$ | 14.18 | 15.75 |
| $K_2O$ | 1.45 | 1.46 |
| LOI | 14.25 | 14.25 |
| Softening Point | 1600° F. | 1575° F. |

Variation of Example II containing 5% anhydrous boric acid

| | |
|---|---|
| $SiO_2$ | 20.85 |
| $Al_2O_3$ | less than 1.00 |
| $Fe_2O_3$ | trace |
| $F_2$ | 9.80 |
| $B_2O_3$ | 9.24 |
| CaO + MgO | 25.58 |
| BaO | 6.06 |
| $Na_2O$ | 13.66 |
| $K_2O$ | 1.28 |
| LOI | 13.53 |
| Softening Point | 1520° F. |

The batch ingredients of the above described mold fluxes are finely divided, say minus 60 mesh U.S. Standard and preferably minus 100 mesh.

The mold fluxes described above can be modified by the addition of boron yielding compounds and/or soda yielding compounds such as powdered borax, anhydrous borax, boric acid, anhydrous boric acid, sodium nitrate, soda ash, sodium fluoride, etc. to increase fluidity and to lower the fusion temperature. Flake graphite may also be added to the mold flux powder where it is desired to have a reducing atmosphere in and about the mold flux.

Within the framework of the basic compositional range set forth in Tables I-A and I-B, mold flux powders having softening point temperatures between about 1500° F. and 2200° F. have been demonstrated. The softening point temperatures can be shifted up or down in the range by changing the blend of glasses, increasing or decreasing the amount of glass, and by varying the ratio of fluorspar to sodium fluoride by the addition of ingredients such as borax, boric acid, anhydrous boric acid.

Having thus described my invention with the detail and particularity required by the Patent Laws, what is desired protected by Letters Patent is set forth in the following claims.

I claim:

1. In the continuous casting of steel wherein the steel is teemed from a tundish to a continuous casting mold, the improvement comprising introducing to said mold during teeming, a mold flux powder, consisting essentially of, in weight percent, at least three sequentially melting systems, the first system comprising 10 to 30 percent of one or more first glasses having softening point temperatures between 1200° and 2000° F., the second system comprising 10 to 30 percent fluorspar mixed with sodium fluoride, and the third system comprising 40 to 80 percent of a mixture of a second glass having a softening temperature higher than said first glass or glasses and whiting, the weight ratio of said second glass to whiting in the mold flux powder being in the range 0.5 to 2, whereby the fusion point, rate of fusion and fluidity can be tailored to the particular continuous casting process involved.

2. The process of claim 1 wherein the ratio of sodium fluoride to fluorspar is between about 1 to 1 and 1.27 to 0.73.

3. The process of claim 1 wherein said first glass or glasses in the mold flux has a softening point between 1200° and 1800° F.

4. The process of claims 1, 2, or 3 wherein said second glass has a melting point between 1800° and 2200° F.

5. The process of claims 1, 2, or 3 wherein said first glass or glasses in the mold flux powder analyses, by weight percent, $Na_2O$-8 to 18; $K_2O$-up to 8; $B_2O_3$-15 to 25; $SiO_2$-20 to 35; $F_2$-4 to 8; CaO-10 to 15; and BaO-10 to 15.

6. The process of claims 1, 2, or 3 wherein said first glass or glasses in the mold flux powder analyses, by weight percent, $Na_2O$-8 to 25; $K_2O$-0 to 8; $B_2O_3$-0 to 25; $SiO_2$-20 to 75; $F_2$-0 to 12; CaO-10 to 30; MgO-0 to 3; BaO-0 to 15; $Al_2O_3$-0 to 3.

7. The process of claims 1, 2, or 3 wherein said second glass in the mold flux powder analyses, by weight percent, $SiO_2$ in excess of 60; alkali oxides less than 20; total $F_2$, $B_2O_3$, $Fe_2O_3$ less than 1; the remainder being alkaline earth oxides and $Al_2O_3$.

8. A composition of matter useful as a flux consisting essential of, by weight 40 to 80 percent of a mixture of refractory glass and whiting in a weight ratio between 0.5 and 2, 10 to 30 percent of a mixture of fluorspar and sodium fluoride, 10 to 30 percent by weight of one or more glasses having a lower softening temperature than said refractory glass, and analyzing, by weight percent $Na_2O$-8 to 18; $K_2O$-up to 8; $B_2O_3$-15 to 25; $SiO_2$-20 to 35; $F_2$-4 to 8; CaO-10 to 15; and BaO-10 to 15, said refractory glasses analyzing, by weight percent, $SiO_2$ in excess of 60; alkali oxides less than 20; total $F_2$, $B_2O_3$, $Fe_2O_3$ less than 1; the remainder being alkaline earth oxides and $Al_2O_3$.

9. In the continuous casting of steel wherein the steel is teemed from a tundish to a continuous casting mold, the improvement comprising introducing to said mold during teeming, a mold flux powder, consisting essentially of, in weight percent, at least three sequentially melting systems, the first system comprising 10 to 30 percent of one or more glasses having softening point temperatures between 1200° and 2000° F., the second system comprising 10 to 30 percent cryolite, fluorspar, sodium fluoride and mixtures thereof present in low melting ratios, the third system comprising 40 to 80 percent of a mixture of refractory glass having a softening temperature higher than said glass or glasses in said first system and whiting, the weight ratio of refractory glass to whiting in the mold flux powder being in the range of 0.5 to 2, whereby the fusion point, rate of fusion and fluidity can be tailored to a particular continuous casting process involved.

* * * * *